US009782026B2

(12) United States Patent
Cohan

(10) Patent No.: US 9,782,026 B2
(45) Date of Patent: Oct. 10, 2017

(54) HIP APPARATUS

(71) Applicant: Macapak, Inc., Highland Park, IL (US)

(72) Inventor: Adam K. Cohan, Highland Park, IL (US)

(73) Assignee: Macapak, Inc., Highland Park, IL (US)

( * ) Notice: Subject to any disclaimer, the term of this patent is extended or adjusted under 35 U.S.C. 154(b) by 0 days.

(21) Appl. No.: 14/247,997

(22) Filed: Apr. 8, 2014

(65) Prior Publication Data

US 2014/0298575 A1 Oct. 9, 2014

Related U.S. Application Data

(60) Provisional application No. 61/809,799, filed on Apr. 8, 2013.

(51) Int. Cl.

| | |
|---|---|
| ***A47G 9/10*** | (2006.01) |
| ***A41D 1/20*** | (2006.01) |
| ***A41C 1/10*** | (2006.01) |

(52) U.S. Cl.

CPC ..... *A47G 9/1045* (2013.01); *A41C 1/10* (2013.01); *A41D 1/20* (2013.01)

(58) Field of Classification Search

CPC ..... A41D 13/0531; A41D 13/0506; A41D 13/0543; A41D 13/06; A41D 1/20; A47G 9/10451; A47G 9/1072; A47G 9/1081; A41C 1/10

USPC ..... 5/631, 634, 601, 611, 624; 2/22, 467, 2/69, 76, 458

See application file for complete search history.

(56) References Cited

U.S. PATENT DOCUMENTS

| | | | | | |
|---|---|---|---|---|---|
| 2,446,006 | A * | 7/1948 | Hendricks | A47C 7/021 | 2/22 |
| 3,170,163 | A * | 2/1965 | Mitchell | A41D 13/015 | 2/113 |
| 3,295,517 | A * | 1/1967 | Stevens | A61F 5/0104 | 2/22 |
| 3,776,540 | A * | 12/1973 | Comando | A61F 5/3715 | 128/882 |
| 4,065,814 | A * | 1/1978 | Fox | A41D 13/02 | 2/227 |
| 4,177,806 | A * | 12/1979 | Griffin | A61F 13/062 | 128/892 |
| 4,805,605 | A * | 2/1989 | Glassman | A61F 5/0193 | 128/882 |
| 4,910,802 | A * | 3/1990 | Malloy | A41D 13/0015 | 2/227 |
| 4,910,818 | A * | 3/1990 | Grabill | A47C 20/021 | 297/423.17 |
| 5,109,546 | A * | 5/1992 | Dicker | A41D 13/0015 | 2/227 |
| 5,201,074 | A * | 4/1993 | Dicker | A41D 13/0015 | 2/227 |
| 5,308,305 | A * | 5/1994 | Romney | A63B 21/4025 | 2/69 |

(Continued)

*Primary Examiner* — Shaun R Hurley
*Assistant Examiner* — Bao-Thieu L Nguyen
(74) *Attorney, Agent, or Firm* — Michael J. Femal; Much Shelist P.C.

(57) ABSTRACT

An apparatus and system for designed for supporting a hip of a pregnant woman who often experiences hip pain associated with her pregnancy to help relieve this pain including a leggings with hook-and-loop belts, straps and strips associated with pillows for the thigh and ankles.

20 Claims, 5 Drawing Sheets

(56) References Cited

U.S. PATENT DOCUMENTS 5,423,164 A * 6/1995 Schneider ..... A41D 1/086 54/44.1
5,664,271 A * 9/1997 Bellavance ..... A47C 20/025 5/630
5,737,773 A * 4/1998 Dicker ..... A41D 13/0015 2/115
5,901,531 A * 5/1999 Rogers ..... B68C 1/00 54/44.1
5,983,407 A * 11/1999 McKay ..... A41D 13/0531 2/231
6,182,311 B1 * 2/2001 Buchanan ..... A47C 20/021 128/845
6,611,964 B2 * 9/2003 Lipsett ..... A41D 1/06 2/227
6,625,829 B2 * 9/2003 Zell ..... A47C 7/383 128/DIG. 23
6,651,258 B2 * 11/2003 Pelensky ..... A41D 11/00 2/227
6,684,410 B2 * 2/2004 Robinett ..... A41D 13/0015 2/228
6,767,603 B1 * 7/2004 Hurst ..... A41D 13/008 2/69
6,795,975 B2 * 9/2004 Marmaropoulos .... H01Q 1/273 2/69
6,807,697 B2 * 10/2004 Druery ..... A47C 20/021 5/640
6,922,860 B2 * 8/2005 Cuddy ..... A47C 20/026 5/632
7,022,096 B1 * 4/2006 Alfieri ..... A63B 71/1225 602/23
7,086,091 B2 * 8/2006 Jordan ..... A41D 13/0007 2/69
7,194,770 B1 * 3/2007 Fecenko ..... A41D 1/06 2/227
7,536,736 B1 * 5/2009 Martinez ..... A47G 9/0253 5/421
7,584,516 B1 * 9/2009 Sneed ..... A47C 20/025 2/23
7,841,020 B2 * 11/2010 Mayfield ..... A41D 13/02 2/227
8,007,457 B2 * 8/2011 Taylor ..... A61F 5/0102 2/69
8,074,310 B1 * 12/2011 Robbins ..... A47C 20/025 5/631
8,156,941 B1 * 4/2012 Simms ..... A47C 20/021 128/845
8,214,926 B2 * 7/2012 Brown ..... A61F 5/0104 2/228
8,535,256 B2 * 9/2013 Taylor ..... A61F 13/06 2/69
8,544,114 B2 * 10/2013 Williams ..... A41D 13/0015 2/227
9,050,179 B2 * 6/2015 Brown ..... A61F 5/0104
9,314,363 B2 * 4/2016 Ingimundarson ..... A61F 5/0102
9,339,065 B2 * 5/2016 Willis ..... A41D 1/06
9,414,954 B2 * 8/2016 Brown ..... A61F 5/0104
2001/0002491 A1 * 6/2001 Ehr ..... A41D 13/06 2/23
2001/0004771 A1 * 6/2001 Chou ..... A41D 1/007 2/227
2002/0188999 A1 * 12/2002 Haar ..... A42B 3/0406 2/69
2003/0046767 A1 * 3/2003 Roston ..... A47C 20/021 5/648
2004/0172761 A1 * 9/2004 Druery ..... A47C 20/021 5/650
2008/0092265 A1 * 4/2008 Gage ..... A41D 27/10 2/69
2008/0282440 A1 * 11/2008 Larson ..... F41H 3/02 2/69
2009/0070910 A1 * 3/2009 McNally ..... A41D 13/04 2/23
2010/0095422 A1 * 4/2010 Lopez ..... A41D 13/065 2/23
2010/0107299 A1 * 5/2010 Ota ..... A41D 13/0015 2/69
2011/0302685 A1 * 12/2011 Fay, III ..... A62B 35/0012 2/69
2012/0041488 A1 * 2/2012 Al Mubayadh ..... A61F 5/01 606/237
2013/0047342 A1 * 2/2013 Schwingendorf ..... A61F 5/3707 5/652
2013/0067628 A1 * 3/2013 Harb ..... A63B 21/0004 2/69
2013/0074269 A1 * 3/2013 Phillips, II ..... A47C 20/021 5/648
2013/0081206 A1 * 4/2013 Ginsberg ..... A61G 13/10 5/623
2013/0174325 A1 * 7/2013 Yang ..... A41B 11/005 2/239
2014/0230116 A1 * 8/2014 Weber ..... A41D 13/0543 2/22
2015/0143621 A1 * 5/2015 Conolly ..... A63B 21/4025 2/467
2015/0297938 A1 * 10/2015 Dyer ..... A63B 21/0557 2/160
2015/0327689 A1 * 11/2015 Howard ..... A47D 5/00 5/655

* cited by examiner

HIP APPARATUS

CROSS-REFERENCES TO RELATED APPLICATION

The application claims priority to U.S. Provisional Patent Application No. 61/809,799 filed Apr. 8, 2013, entitled "Hip Apparatus", the entire contents of which is incorporated herein by this reference.

FIELD OF INVENTION

The present invention relates to an apparatus for supporting a woman's hip and, more particularly, an apparatus designed to support the hip of a pregnant woman who often experiences hip pain associated with her pregnancy to help relieve this pain.

BACKGROUND OF THE INVENTION

It is well known that abdominal distention due to excess weight causes pain. Though not limited to pregnancy, abdominal distention is especially encountered during pregnancy. In this respect, it is known that there is substantial weight gain during pregnancy, especially during the latter 20 gestational weeks. Weight increase during pregnancy may often reach 40 pounds or more with the largest amount of the increase occurring during the last 20 gestational weeks.

It is also well known that during pregnancy, the joints, ligaments and muscle structure of the pelvis and spine are particularly lax to increase the joint laxity and elasticity to accommodate the shape of the fetus.

Hip and pelvic pain is a very common aliment for both men and women. However, these symptoms are usually worse during a pregnancy. There are several reasons for the hip pain symptoms to be worse during a pregnancy. One reason is that during pregnancy the body of a woman releases a hormone called Relaxin. This hormone relaxes and softens joints and muscle tissue to accommodate the baby moving through the birth canal during delivery.

Unfortunately, this hormone can also increase the risk for joint injury and can cause hip pain during pregnancy. Second, as the pregnancy progresses, the uterus becomes larger. As previously stated above, pregnant women also gain weight. The added pressure on the pelvis from the gravid uterus with an unborn fetus developing inside of it and weight gain can aggravate hip and pelvic pain. Lastly, a pregnant woman is instructed to sleep on her side with the left side being more optimal than the right side. This recommendation is usually given after 20 weeks gestation. This positioning helps to optimize placental perfusion with the least amount of stress on the mother's cardiovascular system. However, sleeping in this position causes added strain on the hips and thus leading to more hip pain.

Unfortunately, treatment options for the hip pain are limited due to safety restrictions in pregnancy. There are some treatment recommendations to counter this hip and pelvic pain as listed below but usually these steps supply minimal to moderate relief:

1) Bending legs, not crossing the legs while sleeping
2) Body pillows
3) Heating pads
4) Proper mattresses
5) Hip exercises and stretches
6) Swimming/water aerobics
7) Yoga/Pilates
8) Perinatal massages 9) Maternity belt iliac brace used when woken up & about—not for sleeping
10) BELLA BANDS®
11) Analgesics such as TYLENOL®
12) Sitz baths Therefore, what is really needed to help alleviate the hip pain is added support across the joint to counter the reasons listed above. This is exactly what the apparatus of the present invention accomplishes. The apparatus of the present invention securely holds the ball in the socket of the hip joint while sleeping and therefore lessens the strain across the joint and thus lessens the possible hip pain during a woman's pregnancy.

SUMMARY OF THE INVENTION

The apparatus of the present invention incorporates a unique design to women leggings. The leggings may be made from stretch cotton, a modal fabric that resists pilling and still holds its shape for extended wear during pregnancy. The leggings may have a comfortable midrise to go with a slim elastic waistband that offers an easy fit for pregnant women that generally is ankle-length but the leggings may be shorter or longer in length depending upon the circumstances. So the leggings may be made from a mix of cotton, modal, and small percentage of SPANDEX®. Of course other materials like polyester, rayon and nylon or any combination thereof that is normally used for clothing leggings is a fine material too. Also, leather or rubberized leggings might also be material suitable for the hip support hip apparatus.

So the general stretch cotton leggings of various sizes and colors include fabric hook-and-loop fastener sewn along the inner and outer leg of the leggings or approximately in opposing position with respect to one another.

A belt with fabric hook-and-loop fastener sewn along the inside and outside is also a component part of the apparatus used in combination with the leggings to provide the structure that helps to alleviate hip pain when attached in a number of different ways. A back pillow comprised of a generally foam material inside with a cloth material on the outside includes openings generally at either end of the pillow cloth enclosure thereof to allow the VELCRO® belt to slip through the openings to use the pillow as a cushioned support when engaging the back of a pregnant lady using the support apparatus.

An alternate structure is where 1) the padding is now sewn into the pants; 2) the leg straps of fabric hook-and-loop fastener are sewn into the padding and exit from a slit on the outside of the legs; and 3) the strap is 2 inches thick with a fabric hook-and-loop fastener along the length.

Therefore, the present invention comprises generally cotton leggings of various sizes and colors with Velcro straps sewn along the inner and outer leg of the leggings, a belt with a fabric hook-and-loop fastener sewn along the inside and outside surfaces of the belt, a back support pillow including a foam core and cloth exterior pillow ease includes openings at opposite ends of the pillow case enclosing the foam core wherein the openings in the pillow case receive the belt there through to have the pillow slide onto the belt with opposing ends of a predetermined length of the belt with fabric hook-and-loop fastener hang out of the pillow case to engage the fabric hook-and-loop fastener straps along the inner and/or outer leg of the leggings, a foam thigh support pillow with a fabric hook-and-loop fastener attached thereto for fastening to the belt or to the inner fabric hook-and-loop fastener strap sewn on the inner leg of the legging, and a foam ankle support pillow with a fabric hook-and-loop fastener strap to keep the pillow in place between the ankles on the pregnant woman.

DRAWINGS

DETAILED DESCRIPTION OF THE INVENTION

Figure 1:
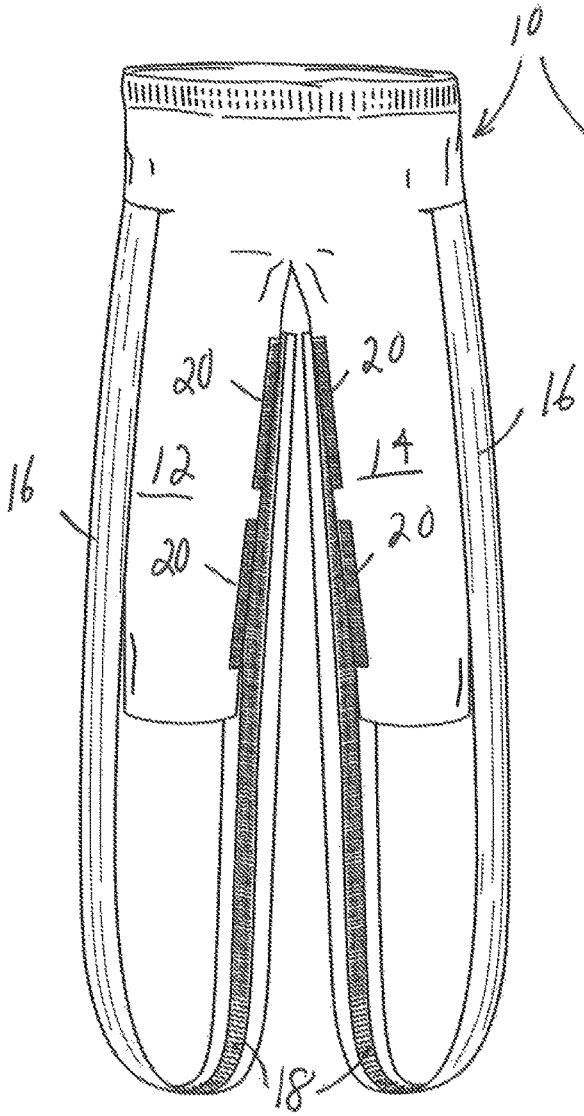
FIG. 1 shows a front view of leggings made in accordance with the present invention.
Figure 2:
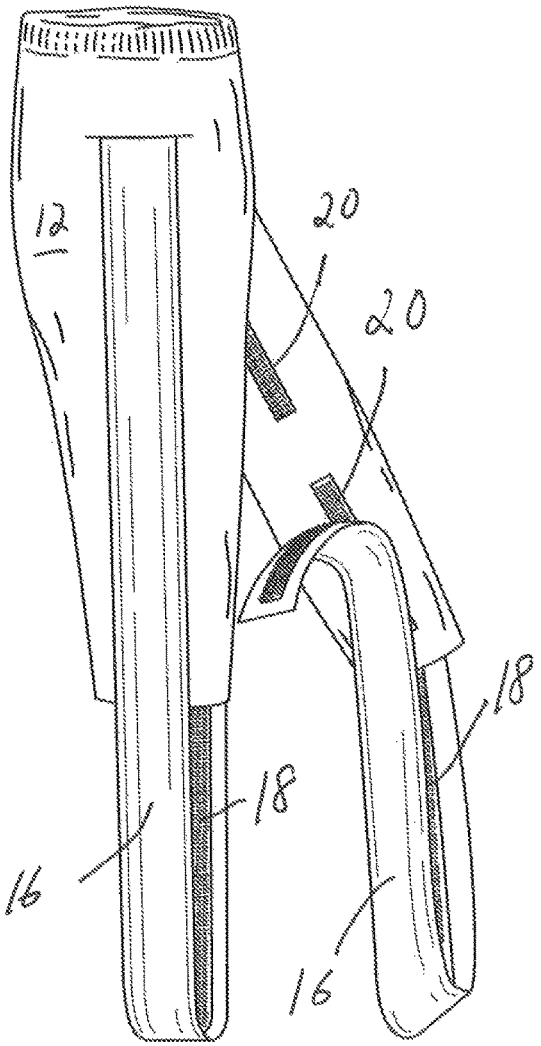
FIG. 2 shows a side view of the leggings of FIG. 1.
Figure 3:
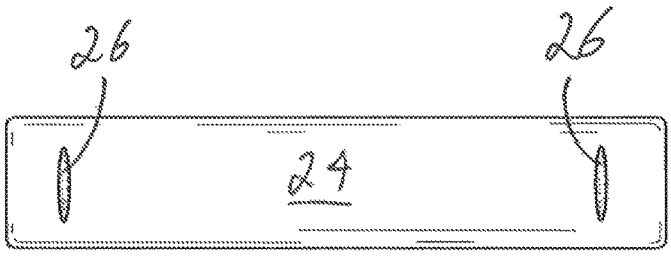
FIG. 3 show a frontal view of a foam core pillow enclosed by a cloth pillow case having openings at opposing ends in accordance with the present invention.
Figure 4:
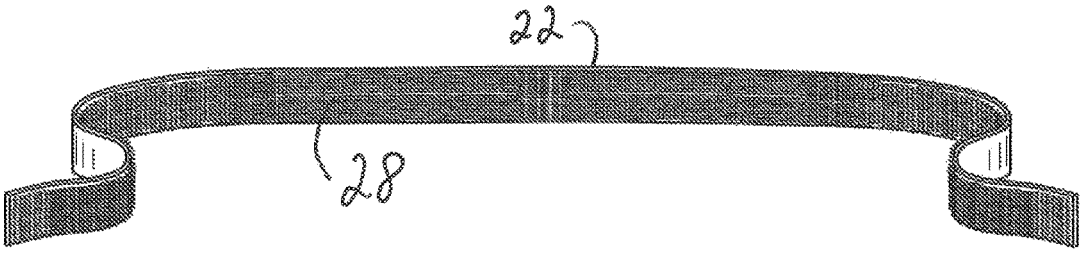
FIG. 4 shows a cloth belt having predetermined strips of fabric hook-and-loop fastener along its length.
Figure 5:
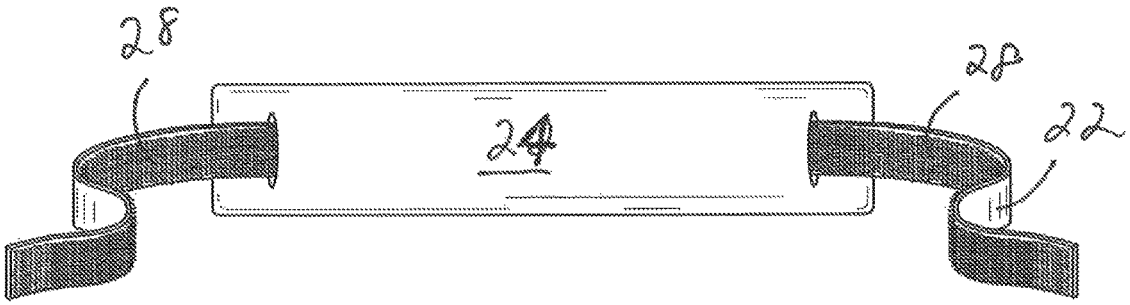
FIG. 5 shows a front view of the cloth belt having a portion of the belt attached to a foam core back support pillow within a cloth pillow case in accordance with the present invention.
Figure 6:
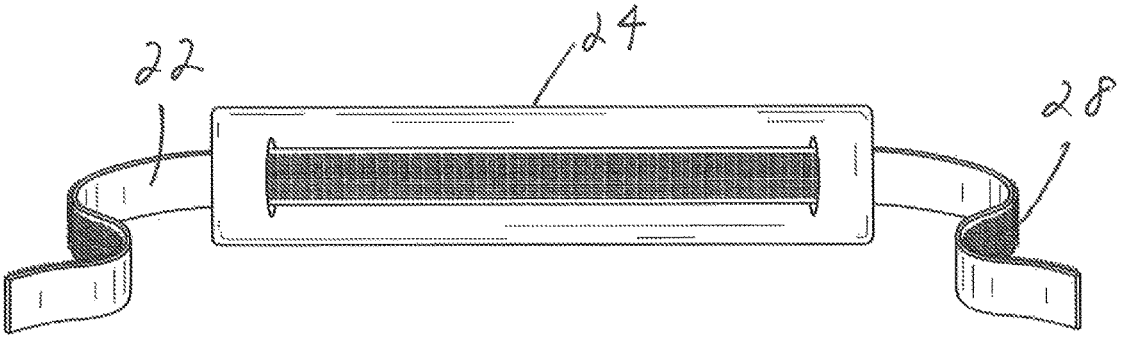
FIG. 6 shows a back view of a cloth belt attached to a foam core back support pillow within a cloth pillow case of FIG. 3.

As shown in FIGS. 1 and 2, a hip apparatus or system made in accordance with the present invention comprises a leggings 10 having two legs 12 and 14 with a strap 16 having fabric hook-and-loop fastener 18 on at least one side over generally the length of the exposed strap 16. As shown in FIGS. 1 and 2, one end of the strap 16 is sewn into the upper portion of the leggings or garment 10. Also, the leggings or garment includes a hook-and-loop strips 20 or the like running down the inside and outside of each leg 12 and 14 a predetermined distance for attachment to the hook-and-loop fastener 18 on the strap 16 or to a belt 22 hanging down from either end of a back support pillow 24 as shown in FIGS. 3, 5, 6 and 10 with a pair of openings 26 on generally opposing ends of the pillow 24 for receiving the belt 22 with a hook-and-loop fastener 28 running generally the length of the belt 22 for attaching to the hook-and-loop fastener 28 to the hook-and-loop fasteners 20 on the outside of the legs 12 and 14, respectively. The pillow 24 is made of a foam block or any other suitable material that is generally solid or slightly flexible but generally holds it shape.

Figure 7:
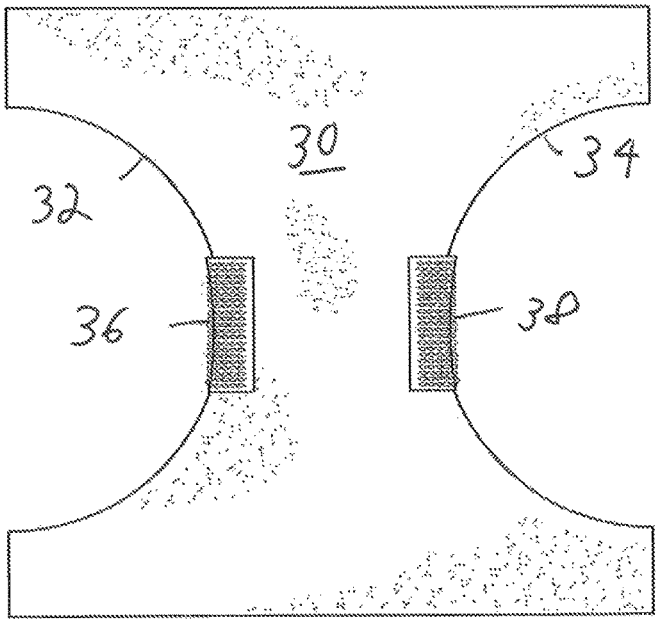
FIG. 7 shows a side view of a foam thigh support pillow in accordance with the present invention having fabric hook-and-loop fastener in the concave portion thereof.
Figure 11:
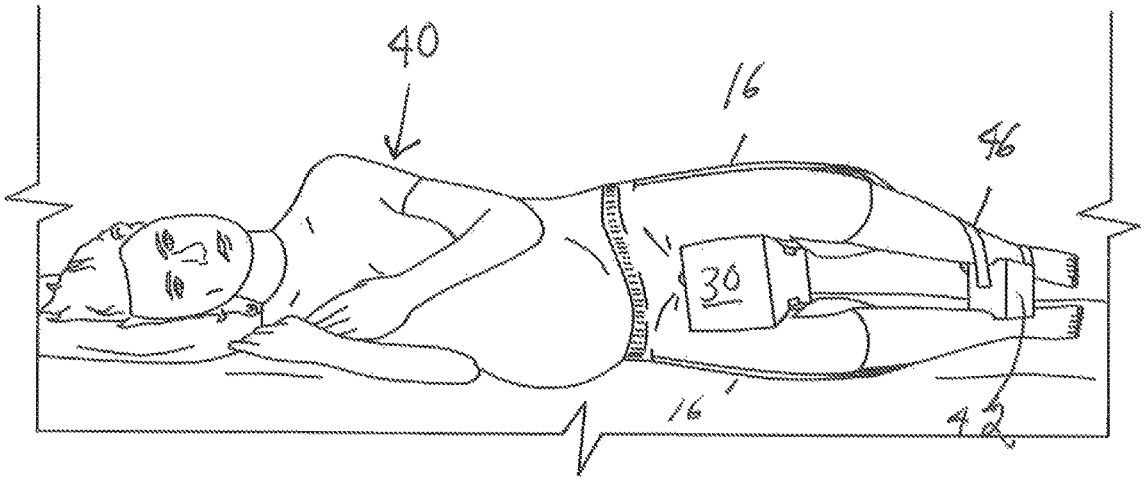
FIG. 11 shows both the thigh and ankle from pillows of FIGS. 7 and 8, respectively.

As shown in FIGS. 7 and 11, a thigh support pillow 30 of similar material to pillow 24 includes opposing concave portions 32 and 34, respectively, with opposing hook-and-loop fasteners 36 and 38 therein that is placed between the thighs of a pregnant woman 40 sleeping on her left side is further attached to either the belt 22 or to the fasteners 20 on inside of the each leg 12 and 14 of the leggings 10.

Figure 8:
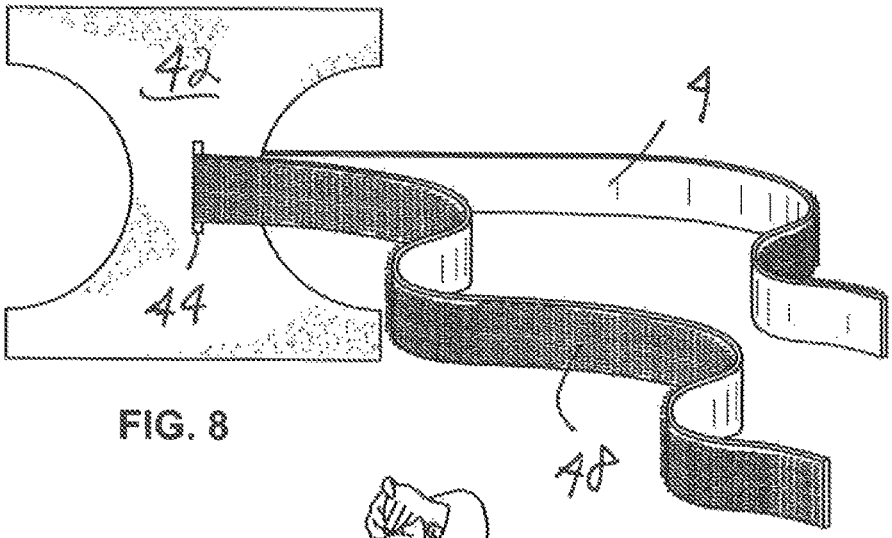
FIG. 8 shows a side view of a foam ankle support pillow with a fastening strap.
Figure 9:
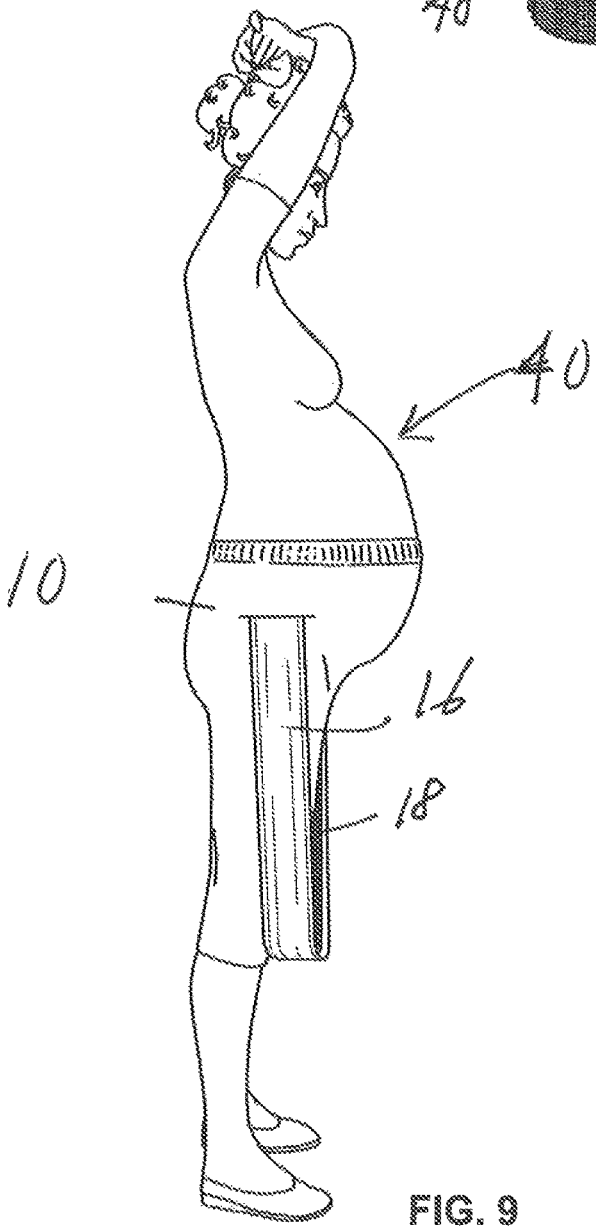
FIG. 9 shows a side view of the leggings on a person in accordance with the present invention.
Figure 10:
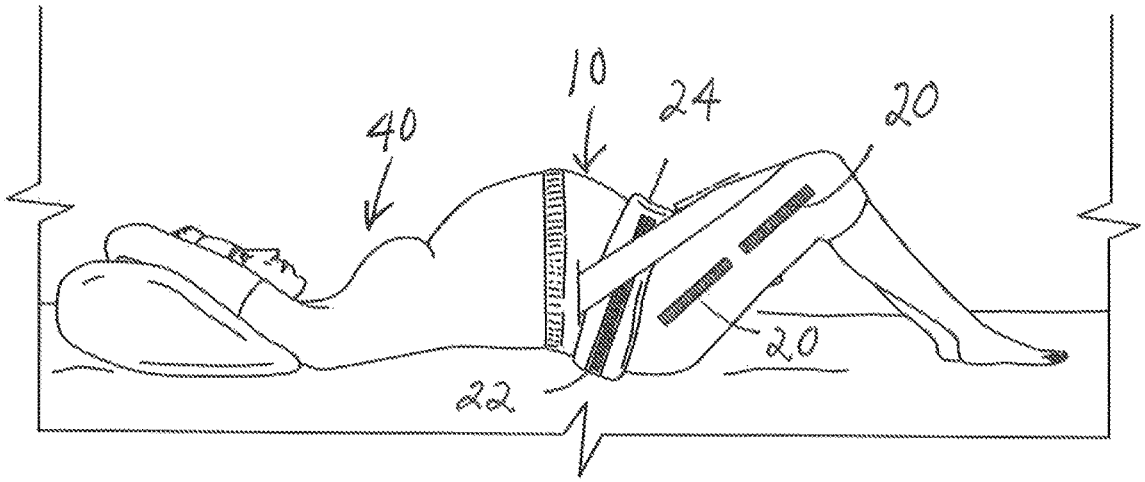
FIG. 10 shows the support pillow around the waist and one end of the belt attached to the outside fabric hook-and-loop fastener on the leg of the legging in accordance with the present invention.

As shown in FIGS. 8 and 11, an ankle support pillow 42 having an opening 44 therethrough for receiving a belt 46 through the opening 44 and having a hook-and-loop fastener 48 generally running the length of the belt 46 is placed between the ankles of a pregnant woman 40 and the fabric hook- and loop fastener 48 or the like to hold the pillow 42 in place between the ankles.

The combination of the leggings 10 of various sizes and colors, hook-and-loop fabric straps or belts 16 sewn into leggings and extending through the pillow 24 within the leggings 10 and having the inner and outer length of each leg 12 and 14 over a predetermined distance with hook-and-loop strips 20 to engage the hook-and-loop fasteners 18 of the belts 16 provide a back support for the pregnant woman 40.

The back support pillow 24 with the opposing openings 26 at either longitudinal end thereof allowing the belt 22 to slide through the openings 26 and then hang down a predetermined distance from either side of the pillow 24 to engage the hook-and-loops strips 20 on the outside of each leg 12 and 14, the thigh support pillow 30 attaching to the inner side of each leg on the leggings 10 and the ankle support pillow 42 attached via hook- and loop strap 46 attached thereto or other fastener are all elements comprising the overall apparatus and system for relieving hip pain in the pregnant women 40 while trying to sleep.

Although the invention has been shown and described with reference to a specific structural embodiment, it is understood certain elements are widely variable in composition of materials and design and that the materials shown do not limit the field of practical application or the substitution of similar materials to achieve the same result. Therefore many modifications and changes are possible without deviation from the scope of the attached patent claims.

What is claimed is:

1. A hip support apparatus and system configured to relieve hip pain during a pregnancy when sleeping in a fetal position on the side, comprising:

an elastic legging with a midrise having an elastic waistband and two legs of a predetermined length, said legs having hook-and-loop fasteners running a predetermined length on the inside of each leg;

a pair of opposing legging straps having hook-and-loop fasteners running a predetermined length on one side of each strap and each leg strap attached to the outside of each legging at generally the midrise of a predetermined length running on the outside length of each legging and then looping back to the inside of each leg of a predetermined length;

a back support pillow having a belt with a hook-and-loop fastener on one side of the belt connected to the back support pillow and the support pillow held in place to provide a support to a hip joint during the pregnancy by the hook-and-loop fasteners of the belt connected to the hook-and-loop fasteners of the leg straps to position the support pillow generally at or near the elastic waistband; and a thigh support pillow having opposing hook-and-loop fasteners held in place by connection to the hook-and-loop fasteners on the inside of each leg;

whereby the legging straps are configured to go around the knee when sleeping in a fetal position on a womans' side to keep the hip ball in the hip socket to reduce the hip pain.

2. The hip support apparatus and system configured to relieve hip pain during a pregnancy of claim 1, wherein the back support pillow is made of foam block or any other suitable material that is generally solid or slightly flexible that holds its shape.

3. The hip support apparatus and system configured to relieve hip pain during a pregnancy of claim 1, wherein the leg straps are sewn into the leggings below the waistband.

4. The hip support apparatus and system configured to relieve hip pain during a pregnancy of claim 1, wherein the thigh support pillow is made of foam block or any other suitable material that is flexible and holds its shape.

5. The hip support apparatus and system configured to relieve hip pain during a pregnancy of claim 1, wherein the thigh support pillow includes concave portions wherein the hook-and-loop fasteners are located at the apex of each concave portion of the thigh support pillow.

6. The hip support apparatus and system configured to relieve hip pain during a pregnancy of claim 1, further comprising an ankle support pillow having concave opposing portions with an ankle strap connected to the ankle support pillow to hold the ankle support pillow in place.

7. A hip support apparatus and system configured to relieve hip joint pain during a pregnancy when a woman is lying on her side to sleep, comprising:

an elastic legging having a waist and two legs, each leg having hook-and-loop fasteners on the inside of each leg;

a pair of opposing legging straps attached at one end to the outside of the legging having hook-and-loop fasteners on one side of each strap, said straps configured to form a loop back to the inside of each leg to adjustably attach the other end of the leg straps to the hook-and-loop fastener on the inside of each leg to hold each each hip joint in place to relief the pain when sleeping on a woman side during pregnancy;

a back support pillow;

a belt with a hook-and-loop fastener on one side of the belt connected to the back support pillow with the belt hook-and-loop fastener connected to the hook-and-loop fasteners of the leg straps to provide support to a hip joint during the pregnancy; and a thigh support pillow having opposing hook-and-loop fasteners held in place by connection to the hook-and-loop fasteners on the inside of each leg.

8. The hip support apparatus and system configured to relieve hip joint pain during a pregnancy of claim 7, wherein the back support pillow includes opposing openings at either longitudinal end thereof allowing the belt to slide through the openings and then to engage the hook-and-loop fastener of the belt to the hook-and-loop fasteners of the leg straps for fixedly positioning the support pillow.

9. The hip support apparatus and system configured to relieve hip joint pain during a pregnancy of claim 7, wherein the leg straps are affixed to opposing sides of the legging below the waist.

10. The hip support apparatus and system configured to relieve hip joint pain during a pregnancy of claim 7, wherein the legging is made of a cotton and elastic material to expand in order to properly fit during a time span of the pregnancy.

11. The hip support apparatus and system configured to relieve hip joint pain during a pregnancy of claim 7, wherein the thigh support pillow includes a foam core and a cloth exterior pillow case.

12. The hip support apparatus and system configured to relieve hip joint pain during a pregnancy of claim 7, wherein the leg straps are approximately two inches wide and a predetermined length having one end sewn into opposing sides of the legging.

13. The hip support apparatus and system configured to relieve hip joint pain during a pregnancy of claim 7, wherein the legging is made of a polyester, rayon, nylon, elastic blend of similar materials or any combination thereof.

14. The hip support apparatus and system configured to relieve hip joint pain during a pregnancy of claim 7, wherein the back support pillow is generally a foam core with a cloth, material enclosure on the outside that includes openings generally at either end of the pillow cloth enclosure thereof to receive the belt for positioning the back pillow.

15. A hip support apparatus and system configured to relieve hip joint pain during a pregnancy, comprising:

a legging having a waist and two legs with hook-and-loop fasteners on the inside of each leg;

a pair of opposing legging straps attached at one end adjacent the waist of the legging having hook-and-loop fasteners on one side of each strap, said straps configured to form a loop to go around the knee of a woman lying on her side during pregnancy back to the inside of each leg to adjustably attach the other end of the leg straps to the hook-and-loop fastener on the inside of each leg;

a back support pillow having openings at either end of the back support pillow;

a belt with a hook-and-loop fastener on one side of the belt slid through the openings of the back support to connect the belt hook-and-loop fastener connected to the hook-and-loop fasteners of the leg straps to provide a support position to a hip joint during the pregnancy; and a thigh support pillow having opposing hook-and-loop fasteners held in place by connection to the hook-and-loop fasteners on the inside of each leg;

whereby the legging straps are configured to go around the knee to hold the ball socket of a hip together during pregnancy.

16. The hip support apparatus and system configured to relieve hip joint pain during a pregnancy of claim 15, wherein the leggings are made of an elastic material that expands for a comfortable fit during all stages of pregnancy.

17. The hip support apparatus and system configured to relieve hip joint pain during a pregnancy of claim 15 wherein the hook-and-loop fasteners on the inside of the legs, on the legging straps, on the belt and on the thigh pillow provide multiple positioning of the back support pillow and thigh pillow to provide support for the hip joint to relieve the pain during a pregnancy.

18. The hip support apparatus and system configured to relieve hip joint pain during a pregnancy of claim 15 wherein the back support pillow and the thigh support pillow are made of a foam core with a cloth exterior pillow case.

19. The hip support apparatus and system configured to relieve hip joint pain during a pregnancy of claim 15, wherein the legging is generally ankle-length or configurable to a predetermined length.

20. The hip support apparatus and system configured to relieve hip joint pain during a pregnancy of claim 15, wherein the legging is made of an elastic cotton or similar material and wherein the legging straps are sewn into the opposing sides of the legging adjacent and below the waist.

* * * * *